US005688238A

United States Patent [19]

Moser et al.

[11] Patent Number: 5,688,238

[45] Date of Patent: *Nov. 18, 1997

[54] MULTI-USE INFANT-FEEDING NIPPLE SYSTEM

[75] Inventors: Ramon Moser, Winter Springs, Fla.; Gustavo Moser, Caracas, Venezuela; Antonio Valery, Longwood, Fla.; Campo Maya; John Maya, both of Kissimmee, Fla.

[73] Assignee: EZ Drink Baby Products, L.C., Winter Springs, Fla.

[ * ] Notice: The term of this patent shall not extend beyond the expiration date of Pat. No. 5,573,507.

[21] Appl. No.: 613,386

[22] Filed: Mar. 7, 1996

Related U.S. Application Data

[63] Continuation-in-part of Ser. No. 399,539, Mar. 7, 1995, Pat. No. 5,573,507.

[51] Int. Cl.[6] ..... A61J 11/00

[52] U.S. Cl. ..... 604/77; 15/11.1; 15/11.4; 604/77; 604/79; 606/236; 606/234

[58] Field of Search ..... 604/77–79; 606/234–236; 215/1 A, 11.1, 11.4, 11; 224/148; 239/33

[56] References Cited

U.S. PATENT DOCUMENTS

| | | |
|---|---|---|
| 42,427 | 4/1864 | Zeno . |
| 102,417 | 4/1870 | Mason . |
| 140,518 | 7/1873 | Mayall . |
| 224,557 | 2/1880 | Potter . |
| 323,597 | 8/1885 | Prime . |
| 593,830 | 11/1897 | Borgenshield . |
| 1,144,980 | 6/1915 | Hilton . |
| 2,063,424 | 8/1936 | D'Amico . |
| 2,989,961 | 6/1961 | Blanchett . |
| 3,065,873 | 11/1962 | Plate . |
| 3,165,241 | 1/1965 | Curry . |
| 3,323,669 | 6/1967 | Yazaki . |
| 3,426,755 | 2/1969 | Clegg . |
| 3,718,140 | 2/1973 | Yamauchi . |
| 3,990,596 | 11/1976 | Hoftman . |
| 4,301,934 | 11/1981 | Forestal . |
| 4,676,386 | 6/1987 | Phlaphongphanich . |
| 4,676,387 | 6/1987 | Stephenson et al. . |
| 4,813,933 | 3/1989 | Turner . |
| 4,898,290 | 2/1990 | Cueto . |
| 5,060,833 | 10/1991 | Edison et al. . |
| 5,105,956 | 4/1992 | Tarng-Lin . |
| 5,535,899 | 7/1996 | Carlson . |
| 5,544,766 | 8/1996 | Dunn et al. . |

*Primary Examiner*—Michael Buiz
*Assistant Examiner*—Nancy Connolly Mulcare
*Attorney, Agent, or Firm*—Dennis H. Lambert

[57] ABSTRACT

An infant-feeding nipple and an infant-feeding nipple system in which the nipple may be used conventionally on a baby bottle or used in conjunction with an elongate conduit connected between the nipple and a container holding liquid to be drunk by the infant. The nipple has a radially enlarged flange on its base end, with a rigid safety ring insert which prevents the flange from being pulled from beneath the cap holding the nipple to a bottle, and which prevents the nipple from being swallowed by an infant when the nipple is detached from a container. In one form of the invention, the nipple has a flexible transverse wall across its base end, with a central opening therethrough for receiving one end of an elongate conduit whose other end may be extended into a container of liquid to be drunk by the infant. Different diameter conduits may be connected to the nipple. An adaptor is provided for sealably connecting the conduit to an open end of a container when the nipple is to be supported remote from the container. The conduit may have shaped ends to resist withdrawal from a nipple, and to prevent blockage of the inlet end by engagement with the walls of the container. A unique baby bottle is also disclosed, having an angled open end so that the longitudinal axis of a nipple engaged thereon is also angularly disposed relative to the longitudinal axis of the bottle, thereby improving the ergonomics of the bottle.

34 Claims, 8 Drawing Sheets

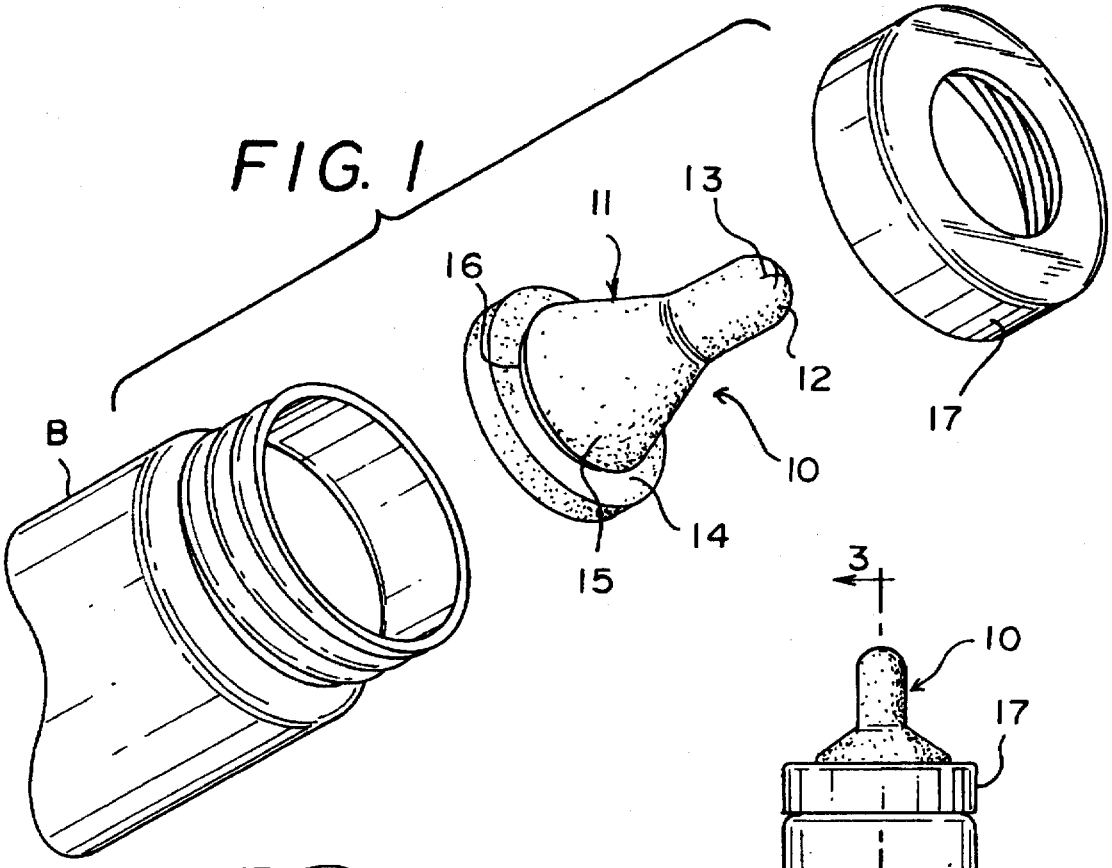
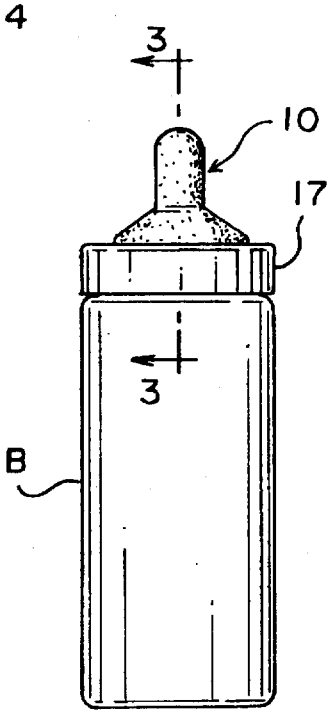
FIG. 2
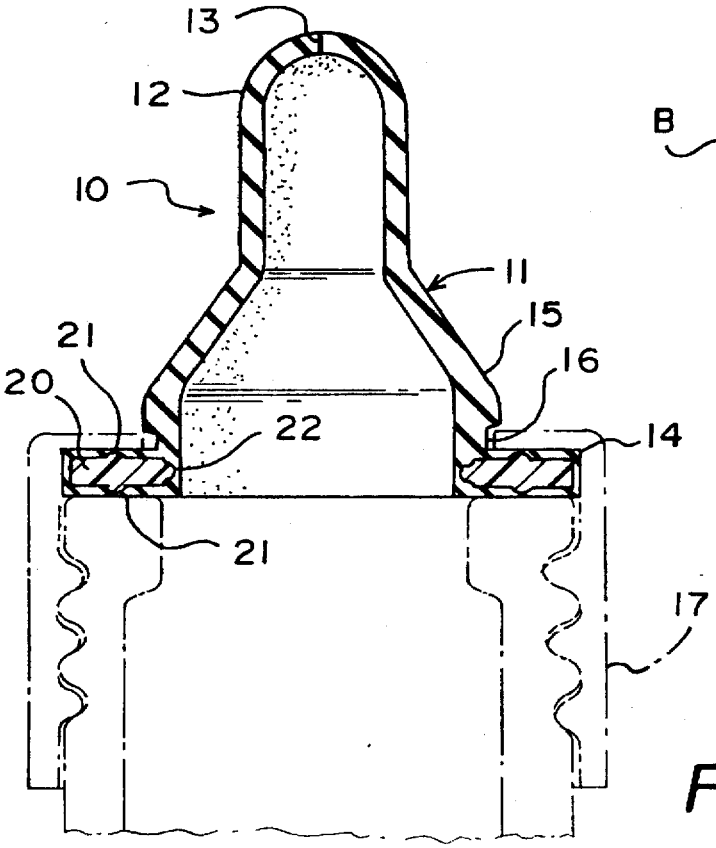
FIG. 3

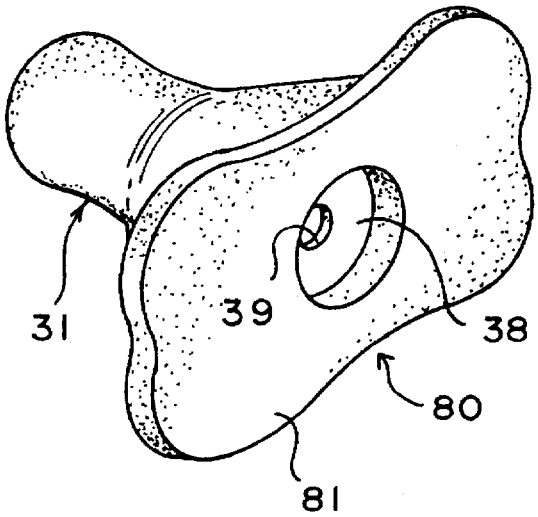
FIG. 21
FIG. 20
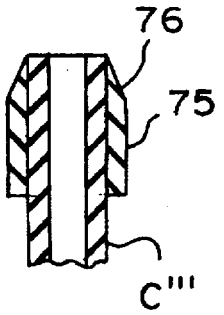
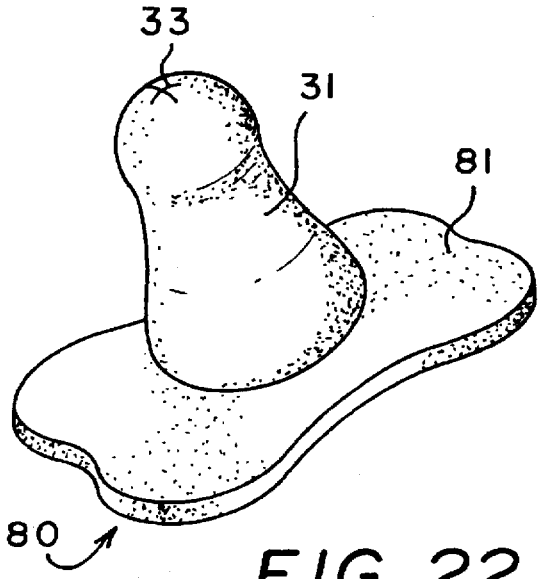
FIG. 22
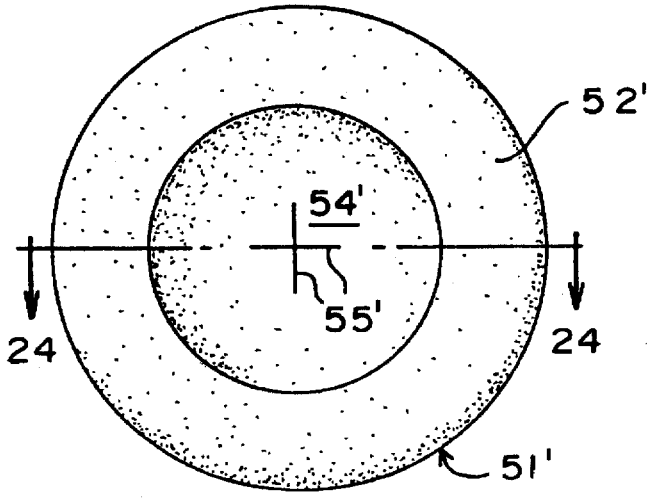
FIG. 23
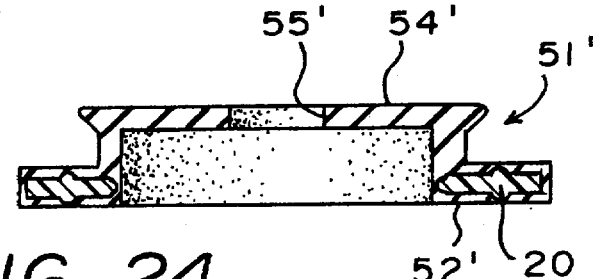
FIG. 24

MULTI-USE INFANT-FEEDING NIPPLE SYSTEM

BACKGROUND OF THE INVENTION

This application is a continuation-in-part of U.S. patent application Ser. No. 08/399,539 filed Mar. 7, 1995, entitled "Multi-Use Infant-Feeding Nipple System", now U.S. Pat. No. 5,573,507.

FIELD OF THE INVENTION

This invention relates to an infant-feeding nipple and system. In particular, the invention relates to a multi-use infant-feeding nipple and system which enables an infant to drink liquid from various types of containers and from containers that need not be held in an elevated position in close proximity to the infant's mouth.

There are many different types of infant-feeding nipples available on the market, most of which must be attached directly to the container or bottle which supplies the liquid to the infant. In these conventional arrangements, the bottle must be elevated above the infant's mouth so that the liquid contained therein fills the nipple attached to the bottle in order to enable the infant to suck on the nipple and draw liquid from the bottle. In order for the infant itself to hold the bottle in a properly elevated position, the infant must generally have reached a certain stage of development and maturity. Moreover, the infant must generally be in a reclining position or sitting in an upright position with head raised and tilted back in order to properly orient the bottle for drinking from it. With such conventional systems, it is not uncommon for the bottle to be lowered from the properly elevated position, permitting the liquid to flow out of the nipple back into the bottle and resulting in the infant ingesting air when an effort is next made to drink from the bottle. This can lead to discomfort and/or frustration of the infant. Moreover, the necessity for holding a conventional bottle in an elevated position in close proximity to the infant's face prevents the infant from engaging in other activities or play while feeding, or requires the assistance of a parent or other attendant, or requires "propping" of the bottle to enable the infant to drink from the bottle while lying down.

Further, conventional nipples have an annular flange which is clamped to the end of a conventional bottle by a threaded retainer ring. This flange is relatively flexible, and a determined infant or toddler can sometimes dislodge the nipple from the bottle by pulling this flange from beneath the retainer ring.

Some specially constructed infant-feeding nipple systems have been developed in the prior art which enable an elongate conduit to be attached to the nipple at one end and to a container of liquid at the other end so that the infant can drink liquid from the container without holding the container in an elevated position in close proximity to the infant's face. However, such prior art systems are either relatively complex and expensive in construction, or are limited in their versatility of use. Further, if one of the parts should be misplaced, the system can no longer function. Moreover, such conventional systems may be difficult to clean and/or sterilize following use, and they do not include check valve means to prevent ingress of air into the nipple and conduit when sucking action ceases, whereby the liquid is enabled to flow out of the nipple and conduit, resulting in loss of prime of liquid in the nipple and conduit and ingestion of air by the infant when feeding is resumed. Further, such prior art systems do not permit a nipple to be used in a variety of ways, e.g., with a conventional soda straw, or conduits of different diameter, or different types of containers, such as bottles, soft-drink and juice cans, or ordinary drinking glasses.

Sometimes it may be desirable for a parent or other attendant to hold the infant while the infant is feeding, and in these circumstances a bottle may be held by the parent or the other attendant in a conventional, properly elevated position in close proximity to the infant's mouth. The parent or other attendant can ensure that the bottle is maintained in the proper conventional position to avoid ingestion of air by the infant, which can otherwise lead to discomfort or frustration of the infant. At other times, however, it may not be convenient or even possible for a parent or other attendant to hold a bottle in a normal, properly elevated conventional position for feeding the infant, and in these circumstances an infant-feeding system is required that does not necessitate holding the container of liquid in an elevated position in close proximity to the infant's mouth. This may occur, for example, when only one parent or other attendant is in company with the infant and is not able to hold the infant and/or the bottle in proper conventional position for feeding in a conventional way, such as when the infant is secured in a car seat and the parent or other attendant is occupied with driving a vehicle or is engaged in other activity.

There is thus need for an infant-feeding nipple which can not be pulled from the retainer ring, and which can not be swallowed by an infant if the nipple should become detached from a bottle. Further, there is need for a nipple system that can be used to feed an infant conventionally, i.e., with the bottle held in elevated position and in close proximity to the infant's mouth, or which can be used in a variety of ways to enable the infant to drink liquid from a bottle that may not be held in an elevated position or even in close proximity to the infant's mouth, or even to drink from a container other than a bottle, such as a carton, soft drink can, glass, or other container. Additionally, there is need for such a device which is simple and economical in construction and easy to clean and sterilize, and which maintains the liquid in the nipple when suction action ceases. Desirably, such a system should enable use with a variety of containers, including conventional baby bottles, and with conduits of different size, including conventional drinking straws, or other conduits of special design. Conventional drinking straws, when used, can be disposed of, thereby simplifying cleaning of the components of the system.

SUMMARY OF THE INVENTION

Therefore, it is an object of the present invention to provide an infant-feeding nipple and system that overcomes the disadvantages of known nipples and systems.

Another object of the invention is to provide a nipple with improved attaching means for securing the nipple to a bottle to prevent it from being dislodged from the bottle by an infant or toddler.

It is also an object of the invention to provide an infant-feeding nipple and nipple system that can be used in a variety of ways, including: drinking from a bottle held elevated in a conventional manner; drinking from a bottle that need not be elevated above the infant's mouth; drinking from a bottle that need not be elevated and may be located remote from the infant's mouth; and drinking from conventional containers such as glasses, cans, cartons, and the like.

A further object of the invention is to provide an infant-feeding nipple system that is inexpensive and simple in construction and which is easy to clean and sterilize following use.

A still further object of the invention is to provide an infant-feeding nipple that may be applied directly to a bottle and used like a conventional nipple, or which may have any of a variety of different diameter and different length conduits attached to it for enabling the infant to drink from a bottle that need not be elevated above the infant's mouth and may even be located remote from the infant, or to enable the infant to drink from conventional containers such as glasses, cans, cartons, and the like.

Another object of the invention is to provide a nipple and adaptor that enables a conduit to be attached to a conventional bottle and the nipple to be attached to the conduit remote from the bottle.

Yet another object of the invention is to provide an infant-feeding nipple system that can be applied directly to a bottle in the same way as a conventional nipple, or which can have a conduit attached to it to enable the nipple to be used with a container that is located remote from the nipple, and further, wherein the nipple is specially constructed to enable attachment to it of different diameter conduits.

A still further object of the invention is to provide an infant-feeding nipple that may be attached directly to a bottle in an conventional way, and which has a specially configured base construction that enables a conduit to be attached to it for extending into the bottle, and wherein the conduit is connected to the nipple such that the conduit is pivotable about its connection with the nipple, so that it can follow the lowest point of the bottle or container, thereby ensuring that the conduit remains immersed in the liquid in the bottle or other container.

Another object of the invention is to provide an infant-feeding nipple in which an opening in the tip end for flow of liquid from the nipple functions as a check valve when sucking ceases, to prevent ingress of air into the nipple and thereby maintain liquid in the nipple so that the infant does not ingest air when feeding resumes.

Yet another object of the invention is to provide a uniquely shaped bottle that supports a nipple at an angle to the longitudinal axis of the bottle to improve the ergonomics of the bottle.

In order to meet the foregoing as well as other objects of the invention, a preferred form of nipple in accordance with a first form of the invention has a specially constructed base that enables it to be attached directly to a bottle in a conventional way, with means to prevent dislodgement of the nipple from the bottle.

In another form of the invention, the nipple also has means for attachment to it of a conduit to enable the nipple to be used either in a conventional way or with a bottle that need not be elevated above the infant's mouth, and even to enable use of the nipple with containers such as glasses, cans, cartons, and the like. In the first, and in this preferred second embodiment of the invention, the base has a rigid, enlarged diameter flange for securing the nipple to a bottle, and which also provides an enlarged, rigid structure that prevents the infant from pulling the nipple from beneath the retaining ring that holds it to the bottle, and prevents an infant from accidentally swallowing the nipple if it should become detached from the bottle, or if it is already detached from the bottle.

A reduced diameter opening is formed in the base end of the second form of the nipple for receiving a conduit when it is desired to use the nipple in other than a conventional way, and this reduced diameter opening is yieldable to accommodate conduits of different diameter. Further, the opening supports the conduit in such a way that when the nipple and conduit are applied directly to a bottle, the conduit is permitted to pivot about its connection with the nipple, so that it can follow the lowest portion of the bottle or other container, thereby ensuring that the inlet end of the conduit remains immersed in the liquid in the bottle.

The reduced diameter opening in the base end of the nipple also enables attachment of a conduit so that the nipple may be located remote from the bottle and used to permit an infant to drink from any ordinary container that need not be held in elevated position or in close proximity to the infant's mouth.

In another form of the invention the base end of the nipple defines a pacifier-like structure that prevents the infant from inadvertently swallowing the nipple, and also reinforces the reduced diameter base end of the nipple to enable it to securely grip a conduit inserted therein.

In a further preferred embodiment the inlet end of the conduit is specially shaped to ensure that it does not become blocked by contact with the walls of the container.

That end of the conduit that attaches to the nipple may also have an enlargement or other suitably shaped end to resist pulling the conduit from the nipple.

The bottle used in the system of the invention may have flexible or yieldable side walls so that it may be squeezed to pressurize liquid in the bottle and force it through the conduit and into the nipple to prime the nipple with liquid without having to first suck on the nipple.

In all forms of the invention, the nipple has an outlet opening in its tip end through which the infant draws liquid from the nipple. In one form of the invention this opening comprises normally closed slits, and this slitted opening functions as a check valve to prevent ingress of air into the nipple through the slitted opening when the bottle is moved from its elevated position and sucking action ceases. This check valve function of the slitted opening in the nipple maintains liquid in the nipple after it has been filled with liquid, thereby ensuring that the liquid will be immediately available to the infant when sucking is resumed. Consequently, the nipple of the invention not only is capable of use in a variety of ways, but also maintains liquid in the nipple at all times and prevents ingestion of air by the infant or frustration due to interrupted feeding when the infant has stopped feeding for a period of time and then resumes feeding. With conventional nipple systems, air flows into the nipple when the infant ceases feeding and liquid in the container is lower than the nipple, resulting in loss of prime of liquid in the nipple and subsequent ingestion of air when the infant attempts to resume feeding.

BRIEF DESCRIPTION OF THE DRAWINGS

The foregoing as well as other objects and advantages of the invention will become apparent from the following detailed description when considered in conjunction with the accompanying drawings, wherein like reference characters designate like parts throughout the several views, and wherein:

FIG. 1 is an exploded, fragmentary top perspective view of a first form of infant-feeding nipple system of the invention, showing how the nipple may be attached directly to a bottle;

FIG. 2 is a side view in elevation, on a reduced scale, showing the nipple and bottle of FIG. 1 in assembled relationship;

FIG. 3 is a longitudinal sectional view of the nipple of FIG. 1, showing a bottle and retainer ring in dot-and-dash lines;

FIG. 20 is an enlarged, fragmentary, longitudinal sectional view of a modified enlargement on the end of the conduit;

FIG. 21 is an enlarged bottom perspective view of a modified nipple which has a base end configured similarly to that of a pacifier;

FIG. 22 is a top perspective view of the nipple of FIG. 21;

FIG. 23 is a bottom plan view of a modified adaptor ring having a normally closed slitted opening for receiving a conduit;

FIG. 24 is a transverse sectional view taken along line 24—24 in FIG. 23;

DETAILED DESCRIPTION OF THE PREFERRED EMBODIMENTS

Figure 6:
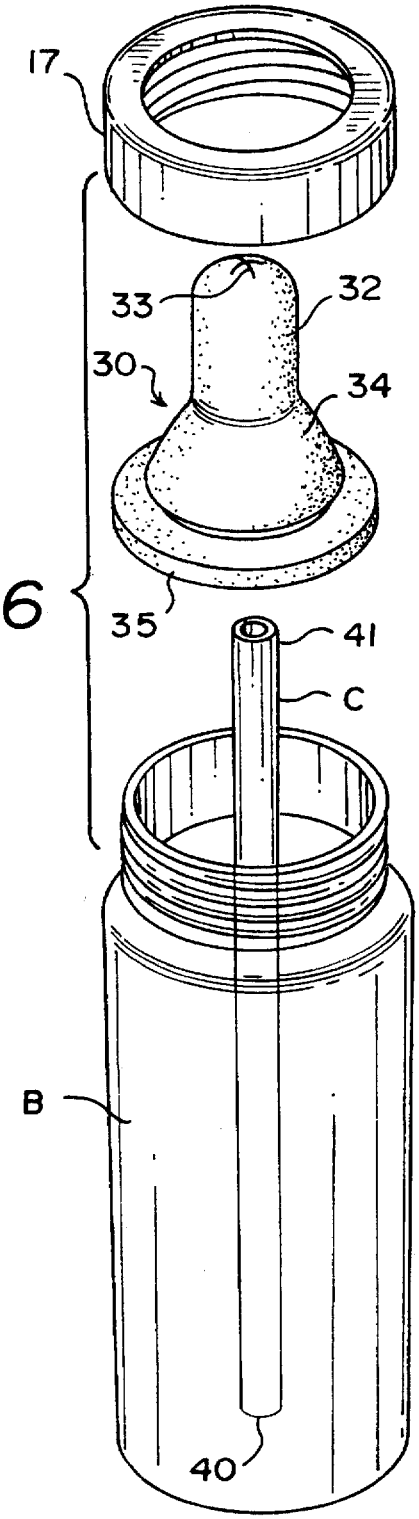
FIG. 6 is an enlarged fragmentary exploded view of the nipple of FIG. 4 shown in combination with a bottle, conduit and retainer ring.
Figure 4:
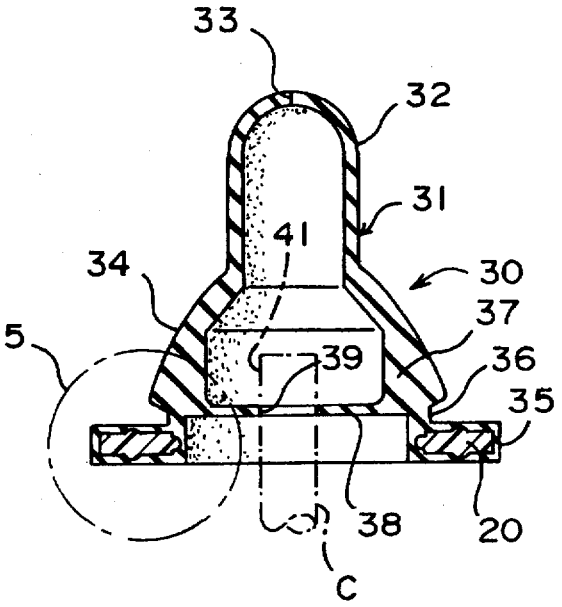
FIG. 4 is an enlarged longitudinal sectional View of a modification of the Nipple shown in FIG. 1, wherein a reduced diameter opening is formed through the base end for attachment of a conduit.
Figure 5:
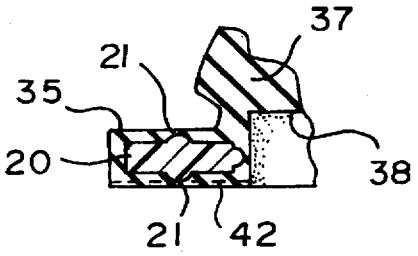
FIG. 5 is an enlarged fragmentary sectional view taken in the circled area 5 in FIG. 4.
Figure 7:
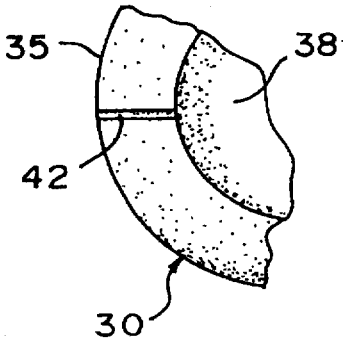
FIG. 7 is an enlarged fragmentary plan view of the bottom of that portion of the nipple shown in FIG. 5, illustrating the vent through the base ring or flange of the nipple for preventing formation of a vacuum in the bottle as liquid is depleted therefrom.
Figure 8:
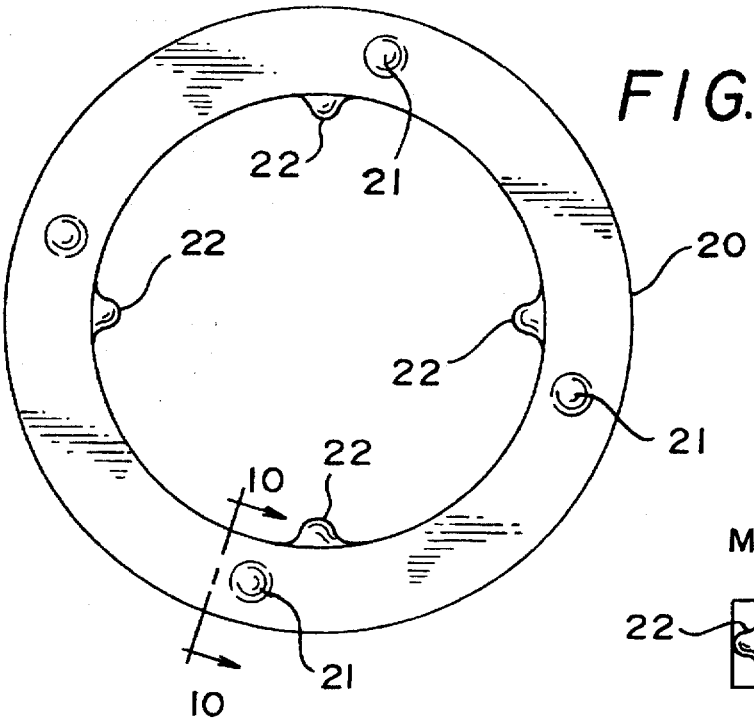
FIG. 8 is an enlarged plan view of the rigid safety ring insert used in the base flange of the nipple to prevent it from being pulled away from its attachment with a bottle, and to prevent an infant from swallowing the nipple if it is detached from a bottle or conduit.
Figure 9:
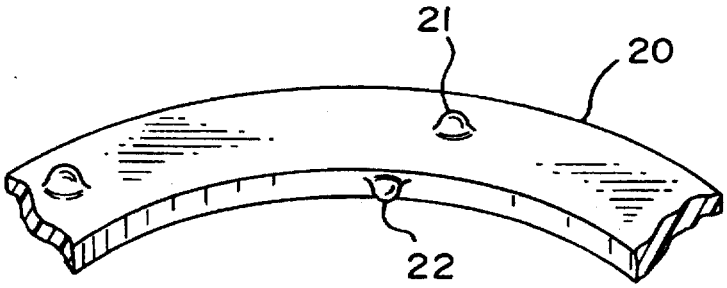
FIG. 9 is an enlarged fragmentary perspective view of a portion of the insert illustrated in FIG. 8.

Referring more specifically to the drawings, a first form of nipple in accordance with the invention is indicated generally at 10 in FIGS. 1 through 3. The nipple is made of a flexible, elastomeric material of a type commonly employed in the manufacture of infant-feeding nipples, e.g., silicone or rubber and the like, and comprises a hollow, tubular body 11 having a tip end 12 with a pair of normally closed crossed slits 13 formed therein, and a radially enlarged flange 14 on its base end. The body 11 is outwardly flared at 15 toward its base end, terminating at the flange 14. An undercut recess 16 is formed in the body between the bottom of the outwardly flared portion 15 and the flange 14 for cooperation with an inner edge of a retaining ring 17 to assist in holding the nipple to a bottle B. The normally closed slits 13 function as a check valve to maintain the nipple primed with liquid when sucking action on the nipple ceases.

As seen best in FIGS. 3 and 8–10, a rigid safety ring insert 20 is molded into the flange 14 to rigidify the flange. The ring 20 may be made of nylon or polyester or other suitable rigid material, and is completely surrounded by the relatively soft material of the nipple 10, whereby a leak-tight seal can be effected between the flange 14 and a bottle B on which the nipple may be secured. The rigid safety ring insert 20 stiffens the flange 14 to prevent an infant or toddler from pulling the flange out from under the retaining ring 17, and also maintains the large annular shape of the flange to prevent the nipple from being swallowed by an infant.

Figure 10:
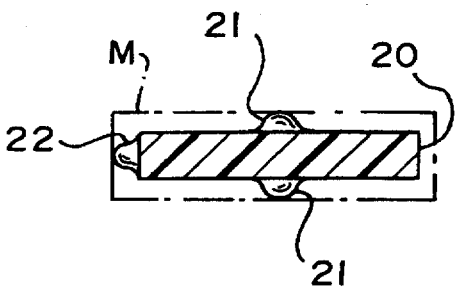
FIG. 10 is an enlarged transverse sectional view taken along line 10—10 in FIG. 8, and showing in dot-and-dash lines how the insert is positioned in a mold cavity for injection of material around the insert to form the base ring on the nipple.
Figure 10A:
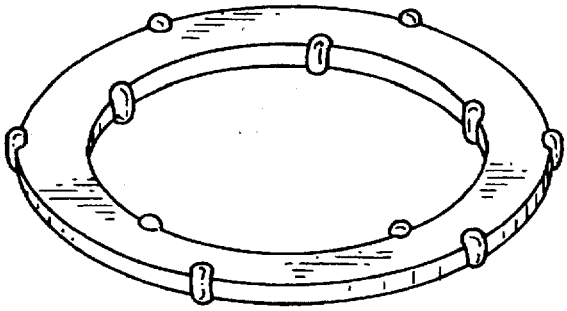
FIG. 10A is a top perspective view of a variation of the rigid ring insert illustrated in FIGS. 8–10.
Figure 11:
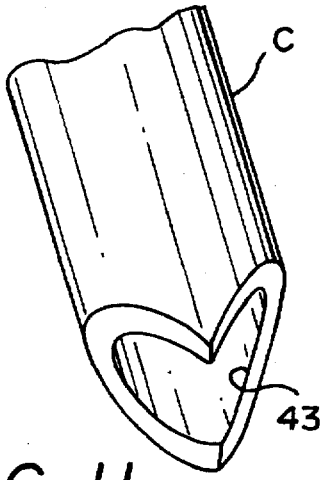
FIG. 11 is an enlarged fragmentary perspective view of the inlet end of the conduit, showing how the end is shaped to prevent it from being blocked by engagement with the walls of the container.

In one form of the invention, the rigid ring 20 has a flat, annular, washer-like shape and has a plurality of circumferencially spaced protrusions 21 on its top and bottom surfaces and a plurality of circumferencially spaced protrusions 22 on its inner margin for centering the ring in a mold M (see FIG. 10) during manufacture of the nipple so that the ring is properly positioned in the molded material of the flange 14. Use of the protrusions eliminates the need for use of pins to center the ring in the mold, thereby eliminating holes in the flange that would be formed upon removal of the pins during the manufacturing process. The protrusions may be placed differently on the ring, i.e., at the edges of the top and bottom surfaces, for example, as shown in FIG. 10A, to leave the top and bottom surfaces unobstructed for a logo or other feature. Although the flange and rigid ring insert have been described as circular or washer-shaped, it is to be understood that these parts could have other shapes, e.g., square, rectangular octagonal, etc. (not shown).

A second form of nipple is indicated generally at 30 in FIGS. 4–7. In this form of the invention, the nipple 30 has a hollow tubular body 31 with an elongate tip end 32 having crossed slits 33 on its end for flow of liquid outwardly through the nipple in response to suction action thereon, and a radially outwardly flared base end 34 terminating in a an enlarged annular flange 35. An annular recess or groove 36 is formed between the flange 35 and the flared base end 34 for cooperation with the inner edge of a retaining ring 17 to secure the nipple to the open threaded end of a bottle B. A rigid ring 20 identical to that previously described is embedded within the flange 35 for rigidifying the flange and preventing dislodgement of the flange from beneath the retaining ring 17.

In contrast to the first form of the invention, the wall of the nipple at its outwardly flared base end 34 may be thickened at 37 to facilitate withdrawal of the core pin during manufacture of the nipple. A transversely extending, relatively thin flexible wall 38 extends across the base end of the nipple spaced axially inwardly of the bottom end of the flange 35. By spacing the wall 38 axially out of alignment with the flange 35 and rigid insert 20, it is much easier to withdraw the core pin during manufacture of the nipple. A central opening 39 is formed through the transverse wall 38 for receiving an end of a tubular conduit C. The conduit C may comprise a length of flexible tubing or a conventional soda straw of correct length (may be cut to length, if necessary) to extend from its inlet end 40 at the bottom of the container to is outlet 41 extended through the wall 38 and into the nipple. Because of the flexible nature of wall 38, a variety of different types and diameters of conduits may be used with the system 30.

Thus, the conduit C may be inserted through the opening 39 in the base end of the nipple 30 and a retaining ring 17 used to secure the nipple on the open end of the bottle B, with the lower or inlet end 40 of the conduit extending to adjacent the bottom of the bottle and the outlet and 41 received in the nipple so that an infant may drink liquid from the bottle without having to invert the bottle.

In this, as well as in the other forms of the invention illustrated and described herein, a transverse narrow channel or groove 42 is formed radially across the underside of the flange 35 to provide a vent between atmosphere and the interior of the bottle to prevent a vacuum from forming in the bottle as liquid is depleted from the bottle.

Further, the lower end of the conduit C preferably is shaped or cut away at an angle on its opposite sides to form an angled opening 43 that prevents blocking of the inlet end of the conduit by engagement thereof with the walls of the bottle B or other container with which the conduit may be used.

A third form of the invention is indicated generally at 50 in FIGS. 12–15. In this form of the invention, an adaptor 51 is provided for connecting and sealing a modified conduit C' with the bottle B so that the nipple 30 can be engaged on the conduit at a location remote from the bottle. The conduit C' in this form of the invention has an inlet end 44 and an outlet end 45, with a shaped enlargement 46 between its ends, as more fully described hereinafter.

The adaptor 51 has an annular flange 52 thereon with a rigid safety ring insert 20 imbedded therein, and a transverse vent channel 42 in its underside, as previously described in connection with nipple 30, for cooperation with a retaining ring 17 to secure the adaptor on the open end of a bottle B. A short cylindrical wall 53 extends upwardly from the inner margin of the flange 52 and supports a transverse, disc shaped wall 54 that extends across and closes the open end of the bottle when the adaptor is in place. A central opening 55 is formed through the transverse wall 54 for slidably and sealingly receiving the conduit C. Afternatively, the conduit may be molded integrally with the adaptor, or secured thereto with an adhesive or other suitable means, or formed with a normally closed slitted opening, as described hereinafter. An annular recess or channel 56 is formed on the outer surface of the adaptor for cooperation with the retaining ring 17.

Figure 13:
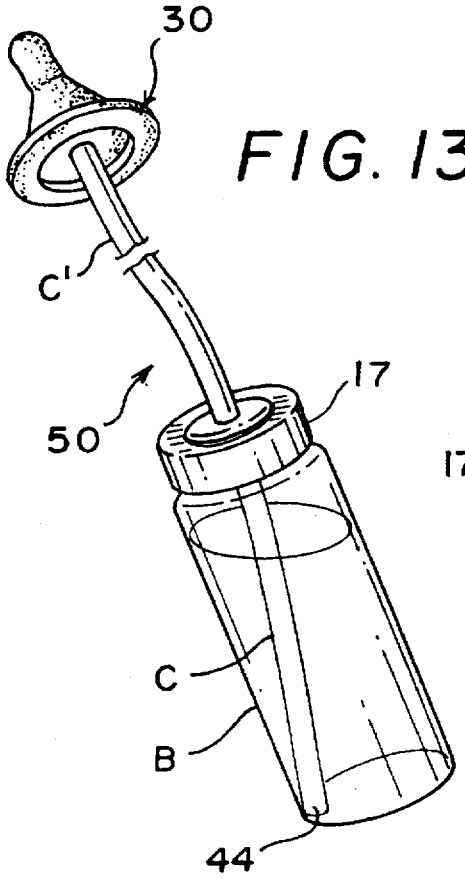
FIG. 13 is a top perspective view, with portions broken away, of a bottle, conduit and nipple combination using the adaptor of FIG. 12.
Figure 12:
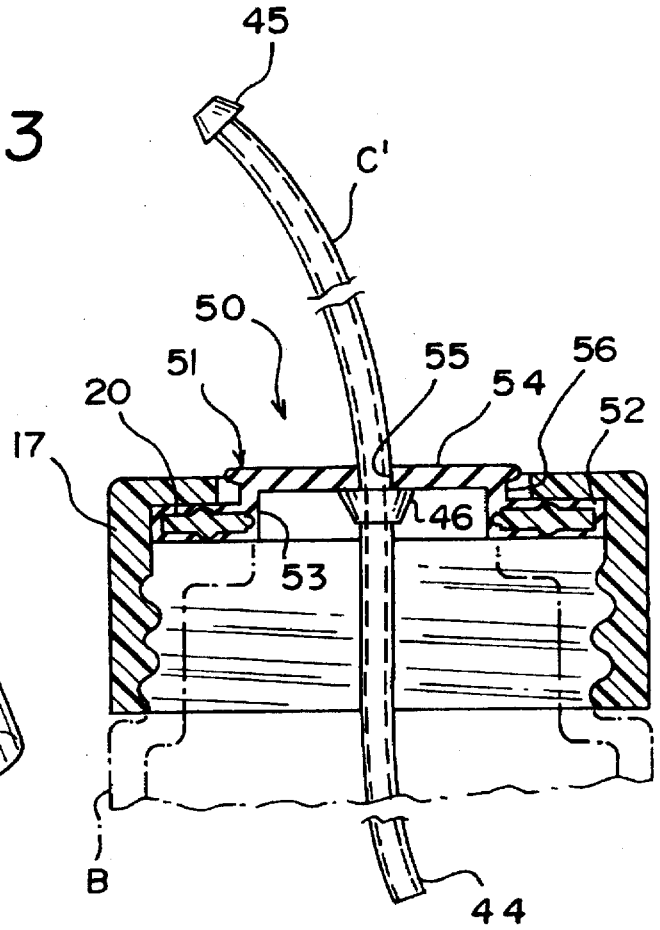
FIG. 12 is an enlarged, longitudinal sectional view of an adaptor that may be secured on the end of a conventional baby bottle to enable an elongate conduit to be attached to the bottle for remote connection of a nipple.
Figure 14:
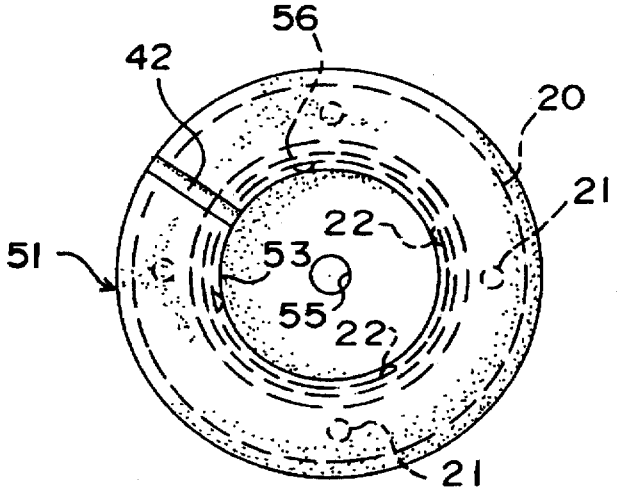
FIG. 14 is a bottom plan view of the adaptor of FIG. 12.
Figure 15:
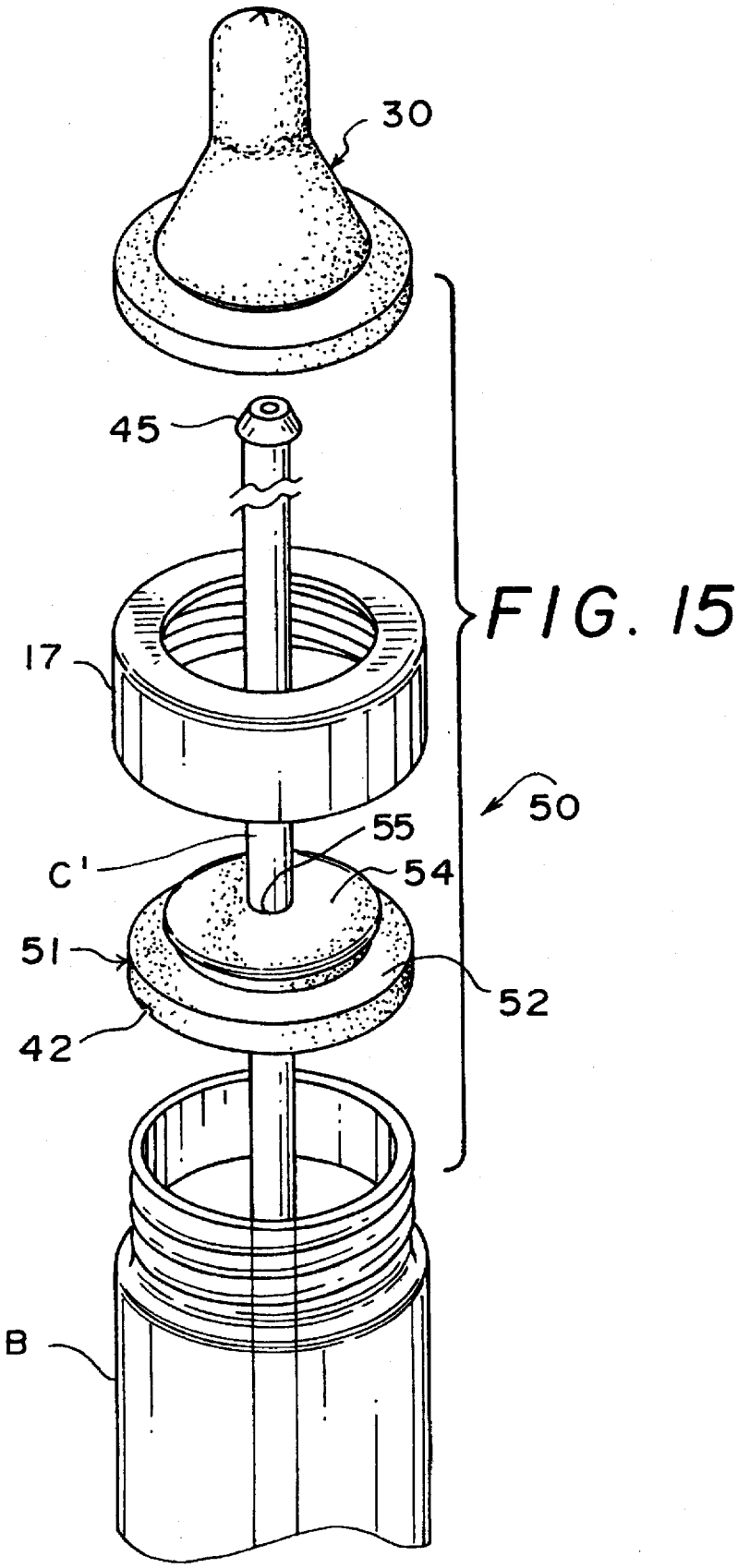
FIG. 15 is an enlarged fragmentary exploded top perspective view of a bottle with the adaptor of FIG. 12 in combination with a retaining ring, conduit and nipple.

Thus, as seen best in FIGS. 13 and 15, either the inlet end 44 or the outlet end 45 of the conduit C' may be inserted through the opening 55, with the enlargement 46 behind wall 54. The adaptor 51 may then be secured over the open end of the bottle B by use of retainer ring 17, with the inlet end 44 of the conduit C' positioned adjacent the bottom end of the bottle. The shaped outlet end 45 of the conduit may similarly be inserted through the transverse wall 38 in a nipple 30 to hold the nipple remote from the bottle. The shaped enlargements on the conduit facilitate insertion of the conduit through the transverse wall 38 in the nipple and the wall 54 in the adaptor, and also resist withdrawal of the ends of the conduit from the adaptor and the nipple.

Figure 16:
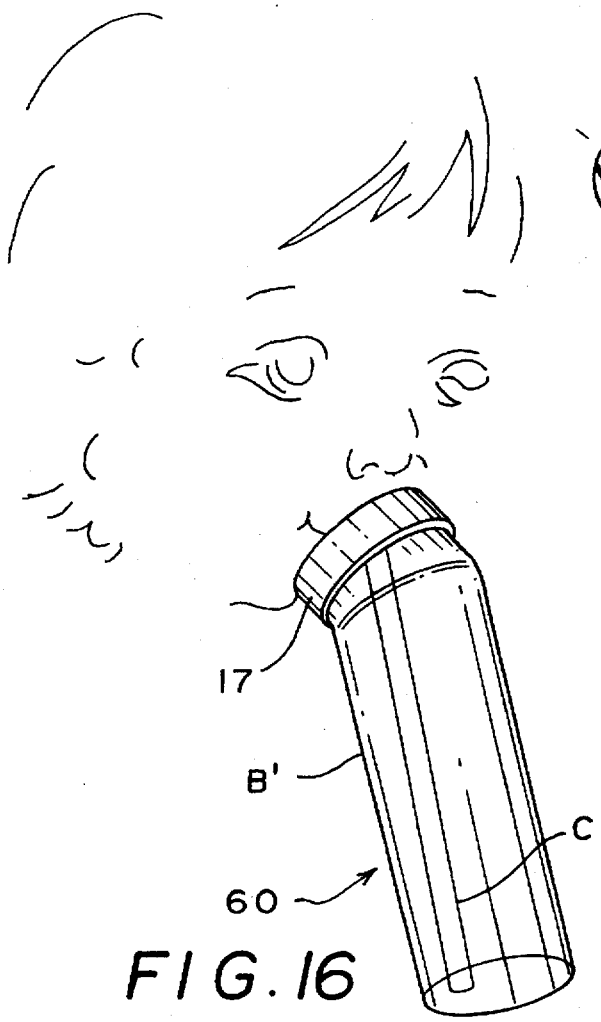
FIG. 16 is a top perspective view of a modified bottle having an angled neck portion for improving the ergonomics of the bottle.
Figure 17:
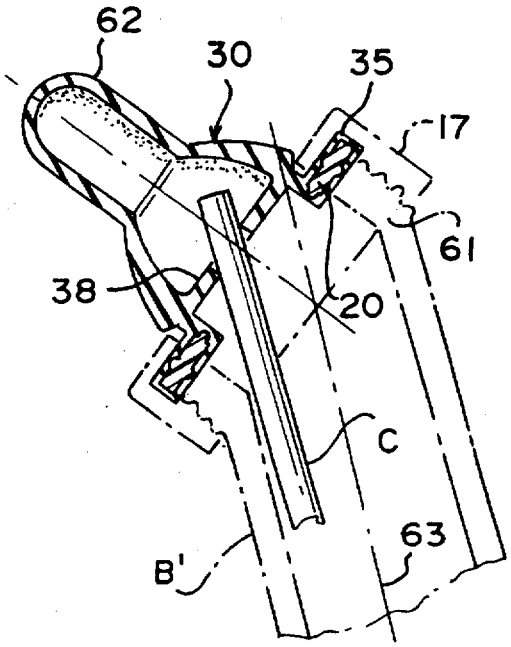
FIG. 17 is an enlarged fragmentary longitudinal sectional view of the upper end of the bottle of FIG. 16, and an attached nipple and conduit.

A fourth variation of the invention is indicated generally at 60 in FIGS. 16 and 17. In this form of the invention, the longitudinal axis 62 of the threaded neck or open end 61 of the bottle B' is angularly disposed to the longitudinal axis 63 of the bottle B', whereby the longitudinal axis of a nipple 30 attached to the bottle, is disposed at an angle to the axis of the bottle. This provides a more ergonomic arrangement in that the bottle need not be elevated as much to enable an infant to drink therefrom. In fact, use of the nipple 30 and conduit C (which may be a conventional soda straw, etc., as described in connection with FIGS. 4–6) according to the invention enables the bottle to remain in a lowered position and yet the infant is enabled to drink therefrom. Further, the flexibility of the wall 38 and the weight of liquid in the conduit results in the conduit pivoting about the point where it passes through the wall 38 and following the lowest portion of the bottle so that the inlet end of the conduit remains immersed in liquid.

Figure 18:
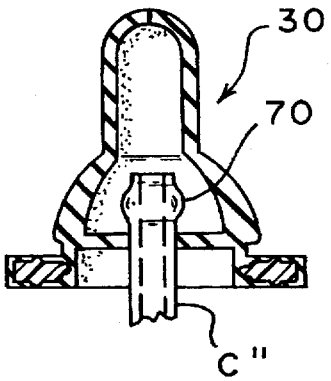
FIG. 18 is a longitudinal sectional view of a nipple such as that shown in FIG. 4, depicting a variation of means on the end of the conduit for resisting pulling of the conduit out of the base end of the nipple.
Figure 19:
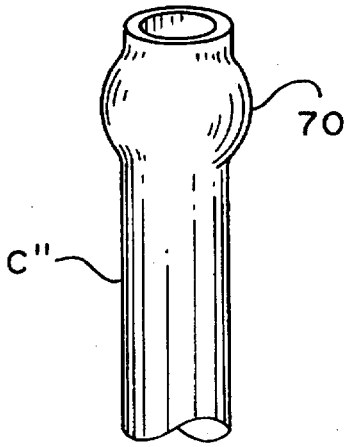
FIG. 19 is an enlarged fragmentary perspective view of the end of the conduit shown in FIG. 18.

FIGS. 18 and 19 illustrate a variation of the shaped end of the conduit C" to resist withdrawal thereof from the nipple 30. In this form of the invention, the shaped end 70 comprises a diametrically enlarged rounded or bulbous area adjacent the outlet end of the conduit C". It should be noted that the shaped ends 44 and 45 that have been illustrated and described herein are merely exemplary of various configurations that may be given to the end of the conduit to resist its withdrawal from the base end of the nipple.

An example of a further construction of an enlarged end is shown in FIG. 20, wherein an outer sleeve 75 is secured over the end of conduit C"', with the end of the sleeve tapered at 76 to facilitate insertion thereof through an associated opening.

Any of the shaped ends described herein may be applied to either or both ends of the conduits, or omitted, as desired.

A further variation of the invention is indicated generally at 80 in FIGS. 21 and 22. In this form of the invention, the flange 35 on the base end of the nipple is replaced with an enlarged, irregularly shaped flange 81 similar to that found on pacifiers. Otherwise, the nipple in this form of the invention includes the tubular body 31 and transverse wall 38 in the base end with a central opening 39 therethrough just as in that form of the invention illustrated and described in connection with FIG. 4.

As mentioned above, the adaptor which may be used to attach a conduit and remotely located nipple to a bottle may have a normally closed slitted opening rather than the opening 55 as previously described. Thus, as seen in FIGS. 23 and 24, the adaptor 51' has an annular flange 52' and transverse wall 54' just as in that form of the adaptor previously described. However, rather than the opening 55, a pair of crossed slits 55' are formed through the center of the transverse wall 54'. The slits 55' are normally closed so that when the adaptor is placed over the open end of the bottle, it closes the open end of the bottle to prevent liquid from spilling therefrom. However, when it is desired to connect a nipple to the bottle, an elongate conduit C' having shaped ends 44 and 45 at its opposite ends is assembled to the adaptor by inserting one of the ends 44 or 45 through the slitted opening 55', and the other end into the base end of a nipple 30. The shaped end on the conduit facilitates insertion of the conduit through the opening, and resists withdrawal through the adaptor.

Figure 25:
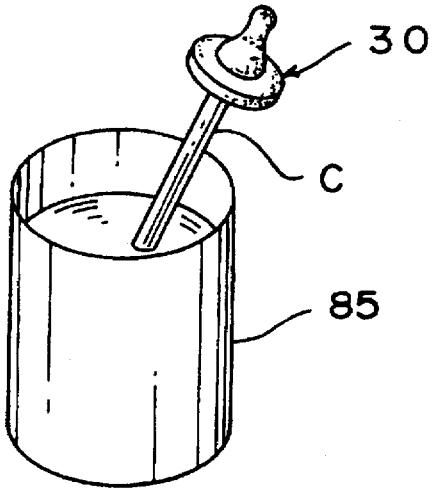
FIG. 25 is a top perspective view of a conduit and nipple combination as used, e.g., for drinking from a glass or similar container.
Figure 26:
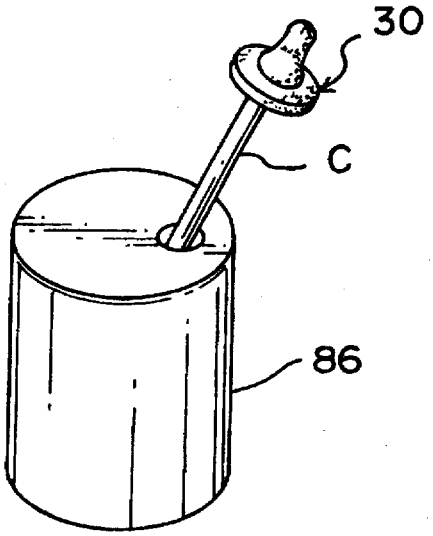
FIG. 26 is a top perspective view similar to FIG. 25, but showing the conduit and nipple combination as it might be used for drinking, e.g., from a soda can.
Figure 27:
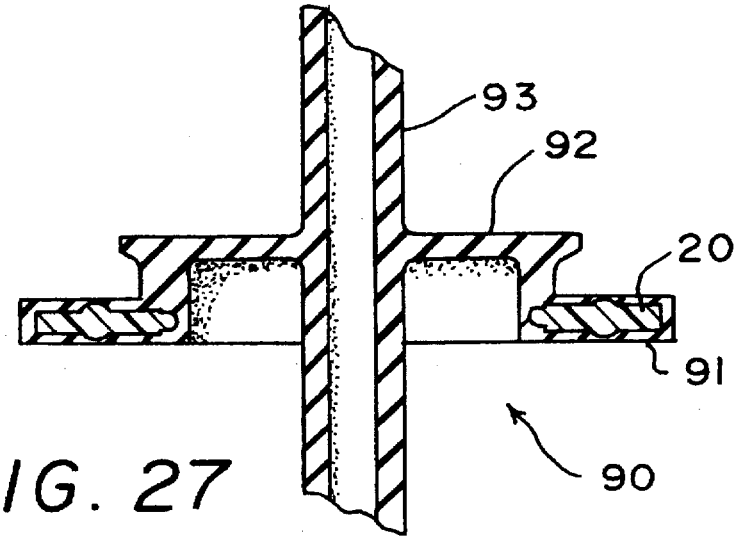
FIG. 27 is an exploded, fragmentary longitudinal sectional view of a modified adaptor wherein the adaptor and conduit are formed integrally with one another.

Further, the versatility of use of the nipple of the invention is further illustrated through FIGS. 25 and 26. In theses figures, it can be seen that a nipple such as nipple 30 illustrated in FIGS. 4–7 can be used with any kind of conduit C, even a conventional soda straw, to enable an infant to drink from glass 85 or can 86, or any other type container. Because of the relatively thin, flexible wall 38 spanning the base end of the nipple 30, the conduit C need not have a specified diameter, but may have any of a wide range of diameters. The flexibility and stretchability of the transverse wall 38 will insure that any of the wide variety of different diameter straws or conduit will be securely received and sealed in the opening through the wall.

Further, the bottle in any of the forms described herein, but especially those forms shown in FIGS. 4–22, may be made with a flexible side wall so that the bottle may be squeezed to press the sides of the bottle inwardly and force liquid into the conduit C to prime the conduit and nipple without requiring any suction action on the nipple. Obviously, with that form of the invention shown in FIGS. 1–3, it is necessary only to invert the bottle to fill the nipple with liquid.

While particular embodiments of the invention have been illustrated and described in detail herein, it should be understood that various changes and modifications may be made to the invention without departing from the spirit and intent of the invention as defined by the scope of the appended claims.

What is claimed is:

1. A nipple adapted to be connected with a source of liquid for feeding infants, comprising:

a flexible tubular body having a tip end and a base end;

opening means in said tip end for flow of liquid through said nipple from said source in response to a sucking action on the nipple;

a radially enlarged flange means on the base end for attaching the nipple to an open end of a bottle, wherein the flange means may be clamped between the end of the bottle and a retaining ring engaged on the end of the bottle; and separate means inserted in said flange means making the flange means less flexible to prevent the flange means from being pulled from under a retaining ring when used to secure the nipple to a bottle.

2. A nipple as claimed in claim 1, wherein:

said said separate means making the flange means (rigid) less flexible comprises a rigid safety ring insert imbedded in said flange means.

3. A nipple as claimed in claim 2, wherein:

said nipple and flange means are integrally molded from an elastomeric material; and said rigid insert comprises a pre-formed rigid ring molded into said flange means during manufacture of said nipple.

4. A nipple as claimed in claim 3, wherein:

self-centering projections are on the rigid ring insert to center it in a mold cavity during manufacture of the nipple so that the material of the flange means is substantially uniformly distributed around the rigid ring insert.

5. A nipple as claimed in claim 4, wherein:

said rigid ring insert comprises an annular, washer-like member having a top surface, a bottom surface, and inner and outer marginal edges; and said self-centering projections are on the top and bottom surfaces and at least one of the inner and outer marginal edges.

6. A nipple as claimed in claim 1, wherein:

a relatively thin and flexible transverse wall extends across the interior of the base end; and a central opening is formed through said transverse wall for slidably and sealably receiving an elongate conduit therein, whereby a conduit may be extended from the nipple to adjacent a bottom portion of a bottle with which the nipple is connected, to enable an infant to drink liquid from the bottle without the need for holding the bottle in an elevated, inverted position.

7. A nipple as claimed in claim 6, where:

the transverse wall is spaced axially inwardly from the base end of the nipple out of the plane of the flange means, to facilitate removal of a mold core pin during manufacture of the nipple.

8. A nipple as claimed in claim 7, wherein:

said nipple and flange means are integrally molded from an elastomeric material; and said separate means making the flange means less flexible comprises a pre-formed rigid ring insert molded into said flange means during manufacture of said nipple.

9. A nipple as claimed in claim 8, wherein:

self-centering projections are on the rigid ring insert to center it in a mold cavity during manufacture of the nipple so that the material of the flange means is substantially uniformly distributed around the rigid ring insert.

10. A nipple as claimed in claim 9, wherein:

said rigid ring insert comprises an annular, washer-like member having a top surface, a bottom surface, and inner and outer marginal edges; and said self-centering projections are on the top and bottom surfaces and at least one of the inner and outer marginal edges.

11. A nipple as claimed in claim 6, wherein:

the nipple is engaged on the end of a bottle and held thereto by clamping the flange means between the end of the bottle and a retaining ring engaged on the end of the bottle.

12. A nipple as claimed in claim 11, wherein:

one end of a conduit is extended through the opening in the transverse wall of the nipple, and the other end of the conduit is extended into the bottle to adjacent the bottom of the bottle.

13. A nipple as claimed in claim 6, wherein:

one end of a conduit is inserted through the opening in the transverse wall of the nipple for supporting the nipple on the conduit, and the other end of the conduit is extended into an open end of a container that is spaced from the nipple, whereby an infant is enabled to drink from a container that is remote from the nipple.

14. A nipple as claimed in claim 6, wherein:

the end of the conduit that is inserted through the opening in the transverse wall in the nipple includes a radially enlarged portion that engages behind the transverse wall to resist withdrawal of the conduit from the opening.

15. A nipple as claimed in claim 14, wherein:

the radially enlarged portion is shaped to facilitate insertion of the end of the conduit through said opening.

16. A nipple as claimed in claim 1, wherein:

said flange means has an annular underside that engages against an end of a bottle when the nipple is secured to the end of the bottle; and a shallow groove extends across said underside to form a vent connecting the interior of the bottle with atmosphere to prevent formation of a vacuum in the bottle as liquid in the bottle is depleted.

17. A nipple as claimed in claim 13, wherein:

the end of the conduit that extends into the container is shaped to prevent blockage of flow of liquid through said other end due to contact between said end and a wall of said container.

18. A nipple as claimed in claim 13, wherein:

an adaptor is secured over the open end of the container; and said other end of the conduit extends through said adaptor and is sealed relative thereto, whereby said adaptor sealingly connects the conduit to the container.

19. A nipple as claimed in claim 18, wherein:

said adaptor comprises a transverse, flexible, disc-shaped wall having an annular, rigid flange means on an outer periphery thereof, said transverse wall extending across said container open end and said flange means engaged against the open end and secured thereto by a retaining ring engaged on the open end of the container; and said conduit extends through a central portion of said wall, with said one end of the conduit located remote from the container and said other end thereof extended into the container to adjacent a bottom thereof.

20. A nipple as claimed in claim 19, wherein:

rigidity is imparted to said flange means by a rigid safety ring insert imbedded in said flange means.

21. a nipple as claimed in claim 20, wherein:

said rigid safety ring insert comprises a pre-formed rigid ring molded into said flange means during manufacture of said adaptor.

22. An infant-feeding nipple system, comprising:

a nipple having a tubular body with a tip end and a base end;

normally closed opening means in said tip end for precluding flow of liquid through said nipple unless a sucking action is being exerted on the nipple;

a relatively thin and flexible transverse wall extending across the interior of said base end; and central opening means formed through said transverse wall for slidably and sealably receiving an end of an elongate conduit therethrough, whereby a conduit may be extended from the nipple to adjacent a bottom portion of a bottle with which the nipple is connected.

23. A nipple for feeding infants, comprising:

a flexible tubular body having a tip end and a base end;

opening means in said tip end for flow of liquid through said nipple in response to sucking action on the nipple;

a relatively thin and flexible transverse wall extending across the interior of the base end in inwardly spaced relationship from the base end; and central opening means formed through said transverse wall for slidably and sealably receiving an elongate conduit therein, whereby a conduit may be extended from the nipple to adjacent a bottom portion of a bottle with which the nipple is connected, to enable an infant to drink liquid from the bottle without the need for holding the bottle in an elevated, inverted position.

24. A nipple as claimed in claim 23, wherein:

a radially enlarged annular flange means is on the base end of the nipple for attaching the nipple to an open end of a bottle and for preventing an infant from swallowing the nipple when the nipple is not attached to a bottle.

25. A nipple as claimed in claim 24, wherein:

an insert is embedded in said annular flange to make the flange less flexible.

26. A rigid ring insert adapted to be placed in a diametrically enlarged annular flange on an infant-feeding nipple to rigidify the flange, said insert comprising a rigid, annular, washer-like ring having annular top and bottom surfaces and inner and outer marginal edges, and protrusion means on said ring, extending above and below the top and bottom surfaces, respectively, and radially beyond at least one of said inner and outer marginal edges such that said protrusions are adapted to engage inner mold surfaces of a mold cavity in which the flange of an infant-feeding nipple is manufactured to center said insert in said mold cavity whereby the insert will be centered in the flange of a nipple molded in said cavity.

27. A flexible nipple for feeding infants, comprising:

a flexible tubular body having a tip end and a base end;

said tip end having opening means therethrough for flow of liquid from the nipple when sucking action is exerted thereon; and said base end having opening means therethrough for receipt of different diameter conduits, whereby the nipple may be used with a variety of conduits having different diameter to enable an infant to drink from a bottle, can, glass or other container.

28. A nipple as claimed in claim 27, wherein:

a radially enlarged flange means is on the base end of the nipple for attaching the nipple to an open end of a bottle and for preventing an infant from swallowing the nipple when the nipple is not attached to a bottle; and an insert is embedded in said annular flange to make the flange less flexible to prevent the nipple from being pulled from a retaining ring when used to secure the nipple to a bottle, and for preventing an infant from swallowing the nipple when it is not attached to a bottle.

29. A nipple as claimed in claim 27, wherein:

the opening means in the tip end of the nipple comprises normally closed check valve means which precludes flow of liquid through the nipple unless a sucking action is being exerted thereon, and which prevents ingress of air into the nipple when sucking action ceases, to thereby maintain liquid in the nipple and prevent backflow of the liquid into the container.

30. A nipple as claimed in claim 27 wherein:

a radially enlarged flange means is on the base end of the nipple for attaching the nipple to an open end of a bottle and for preventing an infant from swallowing the nipple when the nipple is not attached to a bottle;

a rigid ring insert is embedded in said annular flange to impart rigidity to it; and the opening means in the tip end of the nipple comprises normally closed check valve means which precludes flow of liquid through the nipple unless a sucking action is being exerted thereon, and which prevents ingress of air into the nipple when sucking action ceases.

31. A nipple as claimed in claim 30, wherein:

the opening means in the base end of the nipple for receiving conduits of different diameters comprises a thin flexible wall extending transversely across the base end of the nipple, and having a central opening therethrough for receiving the conduit, said flexible wall yielding to accommodate conduits of different diameter.

32. An infant-feeding nipple system as claimed in claim 22, wherein:

a radially enlarged flange means is on the base end of the nipple to prevent an infant from swallowing the nipple, said flange means having a pacifier-like butterfly configuration.

33. An infant-feeding nipple system as claimed in claim 22, wherein:

the transverse wall is spaced inwardly from the base end of the nipple to facilitate removal of the nipple from a mold used in making the nipple.

34. A flexible nipple for feeding infants as claimed in claim 23, wherein:

a conduit is in combination with said nipple, said conduit having a shaped enlarged end to facilitate insertion of said end through the opening means in the base end of the nipple and to resist withdrawal of the shaped and enlarged end of the conduit from the opening means.

* * * * *